United States Patent [19]

Homan

[11] Patent Number: 4,873,727

[45] Date of Patent: Oct. 17, 1989

[54] MARINE TOILET DEODORANT DISPENSER

[76] Inventor: Donald A. Homan, Lighthouse Yacht Landing, Birth 203B, Space D-10, Wilmington, Calif. 90744

[21] Appl. No.: 50,489

[22] Filed: May 15, 1987

[51] Int. Cl.[4] ..... E03D 9/02

[52] U.S. Cl. ..... 4/226

[58] Field of Search ..... 222/190; 239/310; 137/268; 4/228, 226, 222, 223, 224

[56] References Cited

U.S. PATENT DOCUMENTS

| | | | |
|---|---|---|---|
| 317,634 | 5/1885 | Ernst . | |
| 331,693 | 12/1885 | Ernst . | |
| 618,349 | 1/1899 | Heany | 4/225 |
| 647,411 | 4/1900 | Jenkins . | |
| 1,205,513 | 11/1916 | Carlson | 4/225 X |
| 1,691,359 | 11/1928 | Pulkinghorn . | |
| 2,044,821 | 6/1936 | Urban | 137/268 |
| 2,113,203 | 4/1938 | Straubel | 137/268 X |
| 2,120,807 | 6/1938 | Kundel | 137/268 X |
| 3,060,456 | 10/1962 | Jacobs | 4/225 |
| 3,228,040 | 1/1966 | Currier | 4/226 |
| 3,417,410 | 12/1968 | Tietema et al. | 4/225 |
| 3,482,269 | 12/1969 | Tietema et al. | 4/225 |
| 3,591,873 | 7/1971 | Cheng | 4/225 |
| 3,623,167 | 11/1971 | Syrenne et al. | 4/225 |
| 3,964,108 | 6/1976 | Lissau | 4/1 |
| 3,999,226 | 12/1976 | Wolf | 222/57 |
| 4,224,701 | 9/1980 | Huang | 4/206 |
| 4,294,280 | 10/1981 | Tom | 137/268 |
| 4,333,493 | 6/1982 | Besiwenger | 137/268 |
| 4,385,034 | 5/1983 | Gacer | 137/268 X |
| 4,530,118 | 7/1985 | Randall | 4/228 |
| 4,662,387 | 5/1987 | King, Sr. | 137/268 |

FOREIGN PATENT DOCUMENTS

| | | | |
|---|---|---|---|
| 156921 | 1/1921 | United Kingdom | 4/225 |
| 692495 | 6/1953 | United Kingdom | 4/222 |

*Primary Examiner*—Henry J. Recla

*Attorney, Agent, or Firm*—Fulwider, Patton, Rieber, Lee & Utecht

[57] ABSTRACT

A marine toilet deodorant dispenser having intake and discharge pipes for integration into the existing intake flushing line and having a threadedly connected to a cap portion carrying an anti-siphoning device for controlling the fluid during quiescent periods, the cap portion further housing a perforated plastic container or canister enclosing a solid block of disinfectant deodorizer which chemically treats the flushing fluid for deodorizing the bowl of the waste disposal apparatus, accelerating the chemical break down of solid waste, reducing the precipitation and salt build up on plumbing fixtures, and filtering the flushing fluid, the plastic container or canister being conveniently replaceable.

29 Claims, 1 Drawing Sheet

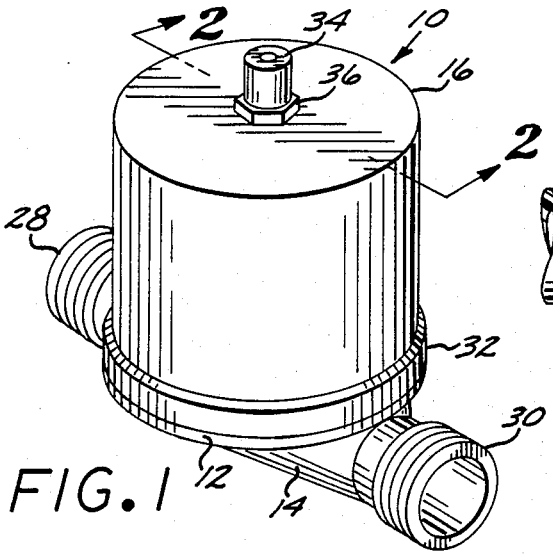
FIG. 1
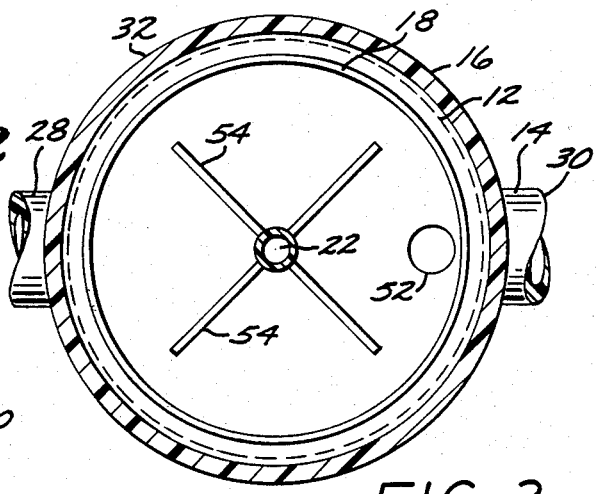
FIG. 3
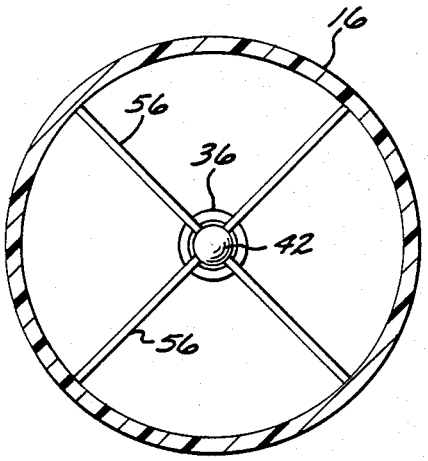
FIG. 4
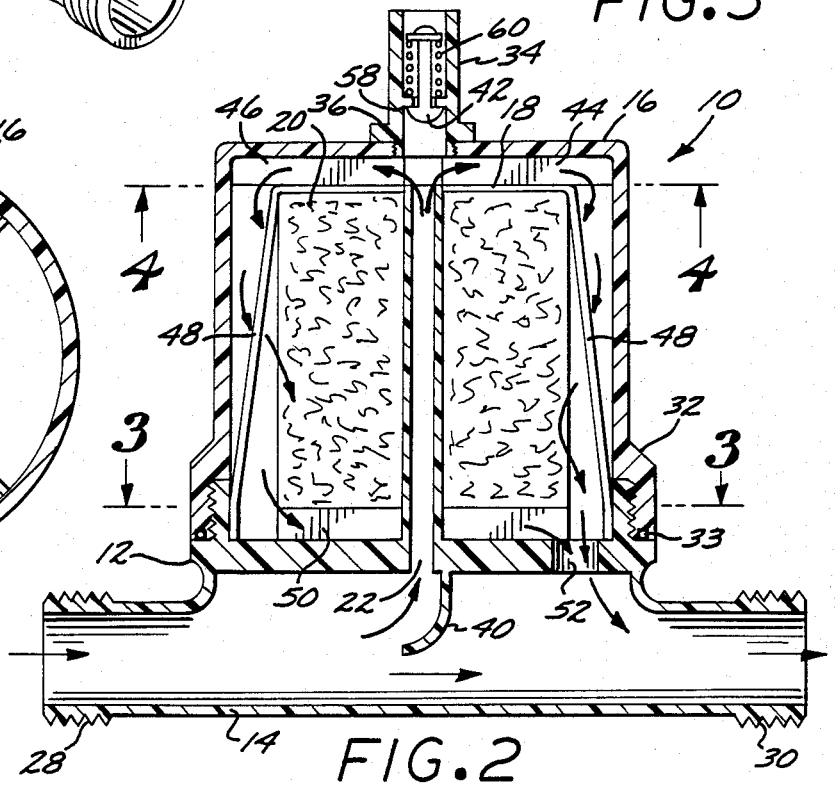
FIG. 2
FIG. 5
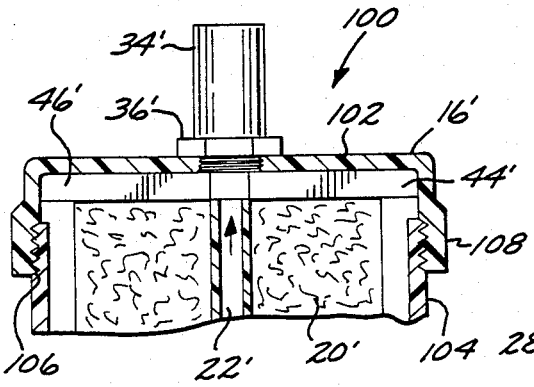
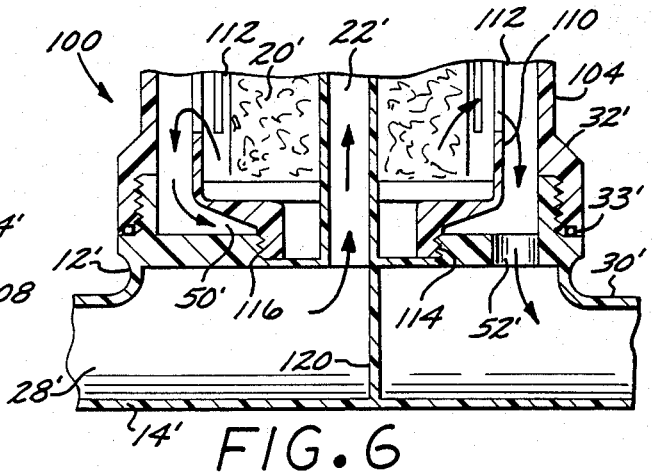
FIG. 6

MARINE TOILET DEODORANT DISPENSER

BACKGROUND OF THE INVENTION

This invention relates to toilet deodorant dispensing systems for use in waste disposal, and more particularly, to marine toilet deodorant dispensing systems which dispense a combination cleaner, deodorizer, and holding tank additive via a solid capsule contained in a flow-through dispenser.

In the field of waste disposal systems, the use of chemicals, detergents, disinfectants, soaps, deodorizers, and coloring in the flushing mechanisms of such systems are known. Obviously, the purpose of such additives to the flushing fluid is to maintain a sanitary condition for the preservation of human health. The problem becomes more intensified when dealing with waste disposal systems on marine vessels.

As is well known, the fluid used aboard vessels for flushing the waste disposal apparatus is salt water which tends to build up and corrode the piping and plumbing fixtures of the waste disposal apparatus. In most marine waste disposal systems, the waste that is flushed from the disposal apparatus while in port is transferred via the sea water to a holding tank. The natural decay of the waste in the holding tank tends to create an odor offensive to humans, resulting in an unsanitary condition. Therefore, another problem which continues to exist is that of deodorizing the bowl of the waste disposal apparatus and the holding tank. In addition to deodorizing the contents of the holding tank, an accelerated chemical break down of tissue paper and waste would greatly alleviate the problem.

The inlet piping which admits the salt water for flushing the waste disposal system aboard marine vessels also admits a plurality of debris which tends to clog the intake piping and the associated mechanics. Elements which are normally found caught in the intake piping include seaweed, barnacles, and the like. In particular, the seaweed tends to get caught in the pumping mechanism for flushing the waste disposal apparatus.

In the past, solutions to this problem included inserting a strainer or filter in the intake line or disassembling and cleaning the clogged pump. If a strainer or filter is inserted in the intake line, periodic preventive maintenance requires removal and cleaning of the filter which is inconvenient and time consuming. If the debris advances sufficiently far to clog the pumping mechanism, several hours and much labor must be expended to disassemble, clean and reassemble the pumping mechanism.

Various filter, deodorizing, disinfecting, and soap dispensing devices for use in various locations of typical waste disposal systems have been known for a number of years.

Various deodorizers, disinfectants, cleaning solutions, soaps, and the like, occurring in pellet, liquid, or solid form have been used in such systems with varying degrees of success. In most of the systems, the disinfectant or deodorant is commingled with the flushing fluid and deposited within the bowl of the waste disposal apparatus either during or after the completion of the flushing cycle. Many of the disinfectants, deodorants, cleaning soaps, and the like are housed within a container which may be threadedly removable from the housing attached to the plumbing system. In some cases, the replacement of the disinfectant or deodorizer is by insertion of additional liquid or pellet form cleaner into the container or by the replacement of a solid cake of the deodorizer or cleaner.

During the flushing cycle, the flushing water is permitted to pass through the container housing the deodorizer, disinfectant, cleaning soap, or the like with the expelled fluid containing a high concentration of the chemical cleaner.

Other devices of the past are employed by inserting the device containing the chemical agent into any of a plurality of the available toilet tanks permitting a small percentage of the chemical to be dispensed with each flushing operation. Yet another device is employed in the drain located in the plumbing below the floor level of a fluid disposal apparatus.

In considering each of the previously recited references, marine waste disposal systems were not addressed. Hence, those concerned with the development and use of marine waste disposal systems have long recognized the need for improved marine toilet deodorant dispensing systems which deodorize the bowl of the waste disposal apparatus, eliminate the salt build up and attendant corrosion of piping and plumbing fixtures, accelerates the chemical decay of the contained waste, and strains and filters a plurality of debris located in the flushing inlet lines. The present invention fulfills all of these needs.

SUMMARY OF THE INVENTION

Briefly, and in general terms, the present invention provides a new and improved marine toilet deodorant dispenser embodying novel methods and apparatus which substantially increase the deodorizing and disinfecting of the waste disposal bowl for improving sanitary conditions, and which significantly accelerates the chemical break down of the stored waste in the holding tank over similar types of previous marine toilet deodorant dispensers. Moreover, the dispenser construction of the present invention provides a strainer or filtering effect for significantly reducing sea life and debris drawn into the flushing intake line, and for significantly reducing the emulsification and build up of salt on and the attendant corrosion of the associated plumbing fixtures.

Basically, the present invention is directed to an improved marine toilet deodorant dispenser located in the inlet flushing line. The dispenser includes an intake and a discharge pipe section for integrating into the existing flushing line with the intake and discharge sections being integrally connected to a base section. The base section is threadedly connected to an upper cap section which carries an anti-siphoning device for controlling the flushing fluid during inactive periods. A solid block of disinfectant and deodorant wrapped within a perforated container is housed within the cap section such that a portion of the incoming flushing fluid is diverted into a central passage located through the solid block permitting the flushing fluid to partially dissolve and carry away a portion of the solid deodorant block during each flushing cycle.

In accordance with the invention, the solid deodorant block is replaceable when exhausted by simply removing the threaded cap section and withdrawing the plastic container which includes the exhausted solid deodorant block and inserting a replacement.

It has been discovered in the development of the present invention, that the control of the intake flushing water level by the anti-siphoning device permits the solid deodorant block to avoid dissolution by the flushing water during inactive periods extending the life thereof.

In accordance with an alternative embodiment, the cap section may be threadedly removable just below the top thereof in addition to the threaded connections at the base portion of the dispenser. Additionally, the plastic container enclosing the solid deodorant block may be replaced with a removable canister having a plurality of slots or holes in the walls thereof and encapsulating the solid deodorant block for convenient insertion into and removal from the dispenser. In this embodiment, the canister may be threaded at the base for mating with the base portion of the dispenser or in the alternative may include a pressure fitting receivable by the base portion and held in position by the dispenser cap section.

The new and improved marine toilet deodorant dispenser of the present invention disinfects and deodorizes the bowl of the waste disposal apparatus, accelerates the chemical break down of the contents of the holding tank, reduces the precipitation and build up of salt and the attendant corrosion of the associated plumbing fixtures, and filters the incoming flushing fluid for eliminating debris within the intake flushing line.

These and other objects and advantages of the invention will become apparent from the following more detailed description, when taken in conjunction with the accompanying drawings, which illustrate, by way of example, the features of the invention.

BRIEF DESCRIPTION OF THE DRAWINGS

FIG. 1 is a perspective view of a marine toilet deodorant dispenser in accordance with the present invention;

FIG. 2 is a cross-sectional view of the marine toilet deodorant dispenser taken along line 2—2 of FIG. 1;

FIG. 3 is a cross-sectional view of the base portion of the marine toilet deodorant dispenser taken along the line 3—3 of FIG. 2;

FIG. 4 is a cross-sectional view of the cap portion of the marine toilet deodorant dispenser taken along the line 4—4 of FIG. 2;

FIG. 5 is a fragmentary cross-sectional view of the cap portion of an alternative embodiment taken substantially along line 2—2 of FIG. 1; and FIG. 6 is an enlarged, fragmentary cross-sectional view of the base portion of an alternative embodiment taken substantially along line 2—2 of FIG. 1.

DETAILED DESCRIPTION OF THE PREFERRED EMBODIMENT

As shown in the drawings for purposes of illustration, the invention is embodied in a marine toilet deodorant dispenser 10 of the type having a base portion 12 integrated into an inlet flushing line 14 of a vessel, including a cap portion 16 for housing a plastic container 18 which includes a solid block of disinfectant deodorant 20 and a central passage 22 for routing the flushing fluid across the solid block.

Generally, toilet chemical dispensers of the past have generally included a housing having one or more chambers therein connected in line with the flushing fluid line from the fluid supply to the waste disposal apparatus. The operation of a hand flapper valve provides a pathway for the gravity flow of the flushing fluid from the reservoir tank to the bowl of the waste disposal apparatus. At least one of the chambers within the dispenser housing contains one or more substances in a liquid, pellet, or solid cake form of a disinfectant, a deodorizer, a soap solution, or a coloring.

As the flushing fluid passes through the housing, the fluid commingles with each of the above-recited substances to form a highly concentrated disinfectant solution for delivery to the bowl for maintaining sanitary conditions. Certain of the examples included devices with an inlet and an outlet port for controlling the passage of the flushing fluid and the amount of disinfectant added as the fluid passed through the dispenser.

The construction of the multi-chambered housing included a first chamber for receiving the flushing fluid which agitated and redirected the fluid to a second chamber in which the disinfectant solution was added prior to the flushing fluid exiting the dispenser.

Other multi-chambered chemical dispensers of the past were designed for immersion within the head tank which was the fluid source provided to the bowl during the flushing cycle. Other devices of the past were designed to be inserted into the outlet flushing lines located downstream of the bowl of the waste disposal apparatus, or in the alternative located below the floor level in the drainage discharge path.

Each of the devices included at least one disinfectant-deodorant type of chemical for mixing with the flushing fluid. However, the toilet chemical dispensers of the past did not include an additive which accelerated the chemical break down of the contents of a holding tank located below the waste disposal apparatus and more importantly did not address the special problems associated with a marine waste disposal system. Therefore, the problems of the precipitation and build up of salt and the attendant corrosion in the piping and plumbing fixtures and the clogging of the piping and pumping apparatus with debris in the inlet flushing lines continues to remain a problem.

In accordance with the present invention, the central passage 22 and the holes in the plastic container 18 wrapped about the solid block of disinfectant-deodorant 20 cooperate to provide an efficient flow path for the flushing fluid flowing through the marine toilet deodorant dispenser 10 for disinfecting a marine waste disposal apparatus located on a vessel. Further, the plastic container 18 including the solid block 20 is modularly replaceable as a single unit, contains an additive for accelerating the chemical break down of the contents of a waste holding tank, reduces the precipitation, salt build up and attendant plumbing fixture corrosion, and acts to filter debris from the flushing line.

The marine toilet deodorant dispenser 10 includes the flushing line 14 which is a piping portion for integrating the dispenser into the existing marine toilet flushing line. The flushing line includes an inlet terminal 28 and an outlet terminal 30, as is illustrated in FIG. 1. Although the inlet and outlet terminals are shown with male threaded connections, the terminal ends of the flushing line 14 may be adapted to include female threaded fittings.

The base portion 12 is shown as an integral unibody construction to the flushing line 14, while the cap portion 16 is illustrated as fitting over the base portion and connected thereto in a threaded or like manner. A bottom part 32 of the cap portion 16 is shown flared and having a larger diameter than the cap portion for accommodating the female threads that are formed within the bottom part (clearly shown in FIG. 2). The solid block of disinfectant deodorizer 20 contained within the plastic container 18 is housed within the cap portion 16.

Additionally, a compressive seal 33 is mounted between the bottom part 32 of the cap portion 16 and the male threads of the base portion 12. The compressive seal 33 may be fashioned out of any suitable flexing compressive material which is resistant to the chemical additives resident within the solid block 20.

An anti-siphon valve 34 is shown extending vertically above the cap portion 16 and held in place by a lock nut 36. When removing the cap portion to obtain access to the solid block 20 within the plastic container 18, the lock nut is merely removed by use of an appropriate tool to permit the removal of the cap portion 16. Once the lock nut 36 is removed, the cap portion may be removed by rotating by hand to permit disengagement of the threads located in the bottom part 32.

The flushing fluid drawn from the reservoir of sea water outside the vessel is shown by a plurality of arrows passing through the flushing line 14 from the inlet terminal 28 to the outlet terminal 30. Extending into the flushing line is an inlet elbow 40 which diverts a portion of the flushing water into the central passage 22. The inlet elbow is integrally molded to the base portion 12 which is comprised of a unibody plastic construction which is generally non-transparent. An example of an acceptable plastic for this application would be polyvinylchloride.

After a portion of the flushing fluid is diverted by the inlet elbow into the central passage 22, the fluid is directed up through the solid block of disinfectant deodorizer 20 located within the plastic container 18. The flushing fluid does not contact the solid block of disinfectant deodorant as it passes through the central passage. However, as the flushing fluid reaches the top of the central passage, the fluid is greeted by the bottom of a stem 42 of the normally closed anti-siphon valve 34. By necessity, the flushing fluid is forced through the passageways 44 and 46 that form the top of the T-fitting above the central passage 22. The flow passageways 44 and 46 are bounded on the top by the bottom side of the cap portion 16 and the top surface of the plastic container 18.

As the flushing fluid passes around the corner in each of the flow passageways 44 and 46, the fluid falls upon and rides down the side of the plastic container 18. Note that the plastic container houses the solid block of disinfectant deodorant 20 but that the container (or shell) is not form-fitting about the solid block 20. The container 18 is comprised of a thin plastic shell which includes a plurality of holes or slots 48 located along the vertical sides of the container. The holes or slots permit the flushing fluid to pass through the thin plastic container or shell and to interface with the solid block of disinfectant deodorant 20. The plastic container 18 may include the plurality of holes or slots 48 in any suitable pattern, including a plastic screen mesh.

While flowing by, the flushing fluid dissolves a portion of the solid block so that the fluid passing out of the dispenser includes a high concentration of disinfectant deodorizer for cleaning the toilet bowl and a chemical additive for accelerating the break down of solid waste in the holding tank (not shown). Further, the disinfectant deodorant substantially reduces the precipitation and salt build up and attendant corrosion in the piping and plumbing fixtures associated with the marine toilet.

Note that the bottom portion of the plastic container 18 is designed to be expanded at the bottom to fit snugly adjacent to the annular male threads of the base portion 12 so that the overall construction of the plastic container appears to be a frustum. The chemically treated fluid which has passed through the plurality of holes or slots 48 and into the space located between the container 18 and the solid block 20 gravity falls to the base portion 12. The fluid is directed through a discharge passage 50 which is annular in shape and passes around the central passage 22. On the right side of the dispenser 10 (as viewed in FIG. 2), a discharge port 52 is located at the bottom of the space located between the container 18 and the solid block 20.

The chemically treated fluid passes through the discharge passage 50 and into the discharge port 52 which expels the chemically treated fluid into the outlet terminal 30 of the flushing line 14. The fluid is then passed through the piping and plumbing fixtures and into the bowl of the marine waste disposing apparatus after the flapper valve or similar device has been activated. Once the marine toilet has been flushed either by hand operation or by electric pump, the chemically treated flushing fluid mixes with existing waste and is pumped overboard when at sea or deposited within the waste holding tank while moored in port.

The solid block of disinfectant deodorizer 20 is comprised of a plurality of chemicals and cleaners well known in the industry and also includes a combiner which permits the block 20 to be molded into a solid block form for the instant application. If the solid block were removed, a view of the base portion 12 of the dispenser 10 in section would disclose the central passage 22 located at the center of a plurality of cross ribs 54 which add structural support to the unibody construction (see FIG. 3). The angular displacement of the cross ribs 54 with respect to the central passage is not critical since the cross ribs do not extend into the flushing line 14.

The discharge port 52 located on the right side of the base portion 12 is consistent with FIG. 2. Note that the discharge port 52 is larger in diameter than the central passage 22 for accommodating the discharge of the chemically treated flushing fluid. The circumference of the plastic container or shell 18 is located behind the male threads of the base portion 12 and the bottom part 32 of the cap portion 16. Also shown is the inlet terminal 28 and the outlet terminal 30.

If the cap portion 16 is removed, a view of the bottom side of the cap portion reveals the bottom of the stem 42 of the anti-siphon valve 34. Since the cap portion 16 is comprised of a clear high-strength plastic for facilitating the inspection of the plastic container 18 and the solid block 20, the lock nut 36 is also visible. Further, a plurality of cross ribs 56 which provide structural support are also visible, as is illustrated in FIG. 4.

The anti-siphon valve 34 is shown threaded into the top of the cap portion 16 and secured by the lock nut 36 to provide a water-tight fitting. The anti-siphon valve is a commercially available item well known in he art and is offered as an optional item for the purpose of eliminating siphon effects caused by vacuums and pressure differentials located in the plumbing lines.

Generally, the problem occurs when the flushing fluid intake line extending through the hull of the vessel is at a location which is physically higher than the marine waste disposal apparatus with reference to the waterline or the piping between the intake and the waste disposal apparatus extends from above the waterline to below the waterline.

It is common in a closed plumbing system for a vacuum to be created resulting in a siphoning action. The siphoning action continues to draw salt water into the waste disposal apparatus with the potential of flooding the compartment. The anti-siphon valve 34 is designed to eliminate vacuums and pressure differentials in the fluid lines and particularly in the deodorant dispenser 10. The anti-siphon valve 34 includes the valve stem 42 having a ball seat 58 held normally closed under the pressure of a coil spring 60.

Normally, the spring 60 is biased to keep the stem 42 firmly closed on the ball seat 58 preventing the atmospheric pressure located outside of the anti-siphon valve 34 from entering. The spring constant of the coil spring 60 is chosen to be slightly below the force provided by the differential pressure required in the line to initiate siphoning. If the differential pressure in the flushing line becomes sufficiently high approaching that of a partial vacuum, the sea water will enter the flushing line intake and flood the bowl of the waste disposal apparatus notwithstanding the position of the flapper valve.

When the differential pressure approaches that which is required to institute siphoning, the spring pressure of the coil spring 60 is overcome unseating the stem 42 permitting atmospheric pressure to enter the piping lines via the dispenser 10. By venting the piping system to atmosphere, the siphon path is extinguished and the bowl of the waste disposal apparatus and associated area is not flooded. Once the differential pressure is released, the spring pressure of the coil spring 60 again seats the stem 42 on the ball seat 58 isolating the fluid lines from atmospheric pressure.

The presence of the anti-siphon valve 34 adds further valuable advantages to the dispenser 10. In certain examples of dispensers of the past, the deodorizing substance was constantly in contact with the flushing fluid notwithstanding the fact that the waste disposal apparatus of that example was in a quiescent mode. The continuous contact of the deodorizing substance with the flushing fluid resulted in a reduced service life of the substance since a high concentration of the chemically treated flushing fluid would be transmitted to the bowl during each flushing cycle. The anti-siphoning valve 34 permits the deodorant dispenser 10 to control the flow of the flushing fluid such that the solid block of disinfectant deodorizer 20 is not in contact with the flushing fluid during quiescent periods.

Another advantage is that the anti-siphon valve 34 facilitates the removal of the cap portion 16 from the base portion 12 for the replacement of the plastic container 18 containing the solid block 20. Since the solid block 20 is not immersed in flushing fluid during quiescent periods, the cap portion may be removed and the plastic container or shield 18 containing the solid block 20 may be physically removed from the shaft forming the central passage and replaced. The replacement container 18 having a central opening is then slipped down over the shaft forming the central passage. Depending upon the number of flushing cycles per unit time, it is anticipated that a single solid block of disinfectant deodorizer 20 will last three months or longer.

Once the plastic container 18 containing the solid block 20 has been replaced, the dispenser 10 is reassembled by aligning the hole penetrating the solid block 20 with the shaft forming the central passage 22 integrally connected to the base portion 12 and sliding the plastic container 18 thereover. Next, the cap portion 16 is fitted over the plastic container 18 and is threadedly connected to the base portion 12 by a rotating hand motion. The anti-siphon valve 34 is threaded back into position and the lock nut 36 secures the water-tight integrity of the anti-siphon valve.

During the intake of flushing fluid in the flushing lines, various sea life, barnacles, and debris including seaweed are drawn therein. The presence of the marine toilet deodorant dispenser 10 in the flushing line 14 substantially reduces the amount of debris passing from the inlet of the flushing line to the mechanical pump associated with the marine waste disposal apparatus. Because of the inlet elbow 40 and the plurality of holes and slots 48 located in the plastic container 18, much of the debris entering the intake flushing line is caught and filtered out in the dispenser. This action results in an advantage, reducing the number of mechanical pump overhauls required to remove such debris from the pumping mechanism. During the periodic replacement of the plastic container 18 containing the solid block 20, the interior of the dispenser may be policed for removing such debris as previously described.

The cap portion 16 of the dispenser 10 is a unibody construction as is illustrated in FIG. 2. The bottom part 32 of the cap portion 16 is fashioned in a flared construction exhibiting a greater diameter for accommodating the male threads of the base portion 12.

An alternative embodiment of the present invention and identified by the general reference character 100 is illustrated in FIGS. 5 and 6. In this instance, the marine toilet deodorant dispenser 100 of FIGS. 5 and 6 also is of the inside-out flow pattern through a solid block disinfectant deodorant somewhat similar to the dispenser of FIGS. 1–4. Parts of the dispenser 100 of FIGS. 5–6 which find substantial correspondence in the structure and function to those of FIGS. 1–4 are designated with corresponding but primed reference numerals.

The cap portion 16' now includes a top section 102 and a body section 104 which are held together by engaging thread connections, as illustrated in FIG. 5. Note that the body section 104 includes a plurality of male threads 106 while the top section 102 includes a plurality of female threads 108 located in a flared portion thereof. This alternate construction permits removing only the top portion 102 of the cap section 16' facilitating an alternative method for replacing the solid block of disinfectant deodorizer 20.

The base of the cap portion 16' and the body section 104 continues to include the flared bottom part 32' including the threaded female receptacle for receiving the male threads of the base portion 12', as is illustrated in FIG. 6. Note that the compressive seal 33' is lodged between the bottom part 32' and the male threads of the base portion 12' for providing a water-tight construction.

Note that the solid block of disinfectant deodorant 20' does not include a plastic container in FIGS. 5 and 6. Therefore, the solid block 20 shown in FIG. 5 is exposed to the flushing fluid once the fluid enters the flow passageways 44' and 46' and then passes down the vertical dimensions of the solid block. In this alternative, the marine toilet deodorant dispenser 100 continues to provide the filtering feature by intercepting the previously described debris and preventing the clogging and break down of the associated mechanical pump. As the solid block 20' is periodically replaced, the dispenser device may be cleaned and policed to remove excessive debris.

A variation of the alternative embodiment 100 includes the solid block of disinfectant deodorizer 20' incorporated in a prefabricated canister 110 which includes a plurality of holes or slots 112 for the chemically treated flushing fluid to pass through. In the upright position the canister may be opened at the top, the opening being surrounded by a plurality of male threads 114. For insertion into the dispenser 100, the canister 110 is tipped upside-down and placed over the central passage 22' and threaded into a set of female threads 116 in the base portion 12'.

In this construction, the flushing fluid may be diverted into the central passage 22' passing through the top and center of the canister 110 as before. However, since the canister is self contained, the flushing fluid strikes the top of the inside of the canister (not shown) and gravity falls down around the solid block of disinfectant deodorizer 20' and out the plurality of holes or slots 112 in the canister. Note that the inlet terminal 28' of the flushing lines 14' is completely isolated from the outlet terminal 30' by a blocking partition 120. In this embodiment, the flushing fluid is forced to flow into the central passage 22' with the chemically treated flushing fluid exiting the plurality of holes and slots 112 and traveling through the annular discharge passage 50' to the discharge port 52'. As before, the chemically treated flushing fluid enters the outlet terminal 30' of the flushing line after discharge from the dispenser 100.

A further variation of this alternative embodiment 100 is to provide the canister 110 with a pressure fitting in lieu of the plurality of male threads 114 located about the opening of the canister. Once the canister 110 is inverted and put in position over the central passage 22', the cap portion 16', as illustrated in FIG. 5, may be engaged with the body section 104 so that the top portion 102 compresses the canister 110 into position. Since the flushing fluid flow through the canister is discharged through the plurality of holes 112, the fluid flow path through the dispenser 100 is not impeded by the pressure contact between the top section 102 and the canister 110.

From the foregoing, it will be apparent that the marine toilet deodorant dispenser 10 of the invention permits the diversion of flushing fluid into the central passage 22 and through the holes and slots of the plastic container 18 for contacting and dissolving a portion of the solid block of disinfectant deodorizer 20 and for discharging the chemically treated flushing fluid from the dispenser for disinfecting and deodorizing the bowl of the marine waste disposal apparatus aboard a vessel. Further, the chemically treated flushing fluid accelerates the chemical break down of solid waste in the holding tank and substantially reduces the precipitation and salt build up and attendant corrosion of the piping and plumbing fixtures. Since the dispenser includes an anti-siphoning valve, overflow and deodorant replacement problems are eliminated.

While several forms of the invention have been illustrated and described, it will be apparent that various modifications can be made without departing from the spirit and scope of the invention. Accordingly, it is not intended that the invention be limited, except as by the appended claims.

What is claimed is:

1. A deodorant dispenser for chemically treating the flushing fluid of a marine toilet comprising, in combination:

means for mounting said deodorant dispenser to a flushing fluid line and including a fluid passage therethrough and a central passage communication with said fluid passage and extending laterally therefrom;

means for admitting said flushing fluid, said admitting means in mechanical communication with said fluid passage for providing an inlet connection;

means for discharging said flushing fluid, said discharging means in mechanical communication with said fluid passage for providing an outlet connection, said admitting and discharging means each being of constant diameter;

fluid collecting means connected to said mounting means for capturing a portion of said flushing fluid in said fluid passage and for routing said portion into said central passage within said deodorant dispenser;

solid chemical block mounted around said central passage, containing means snugly seated within said mounting means for encapsulating said solid chemical block mounted about said central passage, an annular space between said containing means and said block, said containing means having a plurality of vertical slots for directing said flushing fluid to said annular space between said containing means and said block, said containing means being enclosed within a housing means and being easily replaced without contacting said block; and fluid passing means formed between said containing means and said housing means for passing said flushing fluid from said central passage to said annular space for providing contact between said flushing fluid and said block forming a chemically treated flushing fluid outlet means formed in said mounting means in fluid communication between said annular space and said fluid passage wherein said housing means cooperates with said central passage for routing said flushing fluid through said dispenser and being threadedly engaged to said mounting means for providing a leakproof seal.

2. The deodorant dispenser of claim 1 wherein said mounting means comprises a base portion of said dispenser.

3. The deodorant dispenser of claim 2 wherein said base portion is comprised of an opaque plastic material.

4. The deodorant dispenser of claim 1 wherein said admitting means comprises an inlet pipe having a plurality of male threads for connection to an inlet flushing line.

5. The deodorant dispenser of claim 1 wherein said admitting means comprises an inlet pipe having a plurality of female threads for connection to an inlet flushing line.

6. The deodorant dispenser of claim 1 wherein said discharging means comprises an outlet pipe having a plurality of male threads for connection to an admitting flushing line.

7. The deodorant dispenser of claim 1 wherein said discharging means comprises an outlet pipe having a plurality of female threads for connection to an admitting flushing line.

8. The deodorant dispenser of claim 1 wherein said fluid collecting means comprises an inlet elbow.

9. The deodorant dispenser of claim 1 wherein said container means comprises a plastic containing.

10. The deodorant dispenser of claim 9 wherein said plastic container is shaped in the form of a frustum.

11. The deodorant dispenser of claim 1 wherein said solid chemical block comprises a disinfectant deodorant for partially dissolving in and chemically treating said flushing fluid.

12. The deodorant dispenser of claim 1 wherein said housing means comprises a cap portion of said dispenser.

13. The deodorant dispenser of claim 12 wherein said cap portion is comprised of a clear durable plastic.

14. The deodorant dispenser of claim 1 further including a sealing means located between said mounting means and said housing means for providing a leakproof seal.

15. The deodorant dispenser of claim 1 further including an anti-siphon valve mounted in the top of said housing means in line with said central passage for eliminating pressure differentials and siphoning effects within said deodorant dispenser.

16. The deodorant dispenser of claim 15 wherein said anti-siphon valve is spring-loaded normally closed and is opened when the atmospheric pressure exceeds the internal pressure of said dispenser.

17. The deodorant dispenser of claim 1 wherein said fluid passing means further includes an annular passage located within said containing means for collecting said flushing fluid after contacting said solid chemical block.

18. The deodorant dispenser of claim 1 wherein said mounting means further includes a drain for discharging said chemically treated flushing fluid.

19. A deodorant dispenser for chemically treating the flushing fluid of a marine toilet comprising, in combination:

a base portion having a flow passage therethrough and including means for mounting said deodorant dispenser to a flushing fluid line, said base portion further including a central passage communicating with said flow passage and extending laterally therefrom;

a flushing line inlet connection in mechanical communication with said flow passage in said base portion for admitting said flushing fluid;

a flushing line outlet connection in mechanical communication with said flow passage in said base portion for discharging said flushing fluid, said inlet and outlet connections each being of constant diameter;

an inlet elbow connected to said base portion within said flow passage for capturing a portion of said flushing fluid in said flow passage and for routing said portion of said flushing fluid into said central passage of said deodorant dispenser;

a solid block of disinfectant deodorizer mounted around said control passage, a plastic container snugly seated within said base portion and encapsulating said solid block of disinfectant deodorizer mounted about said central passage, an annular space between said container and said block, said central passage penetrating the center of said plastic container for receiving and directing said flushing fluid, said plastic container having a plurality of vertical slots for directing said flushing fluid to said annular space between said plastic container and said solid block, said plastic container being housed within a cap portion and being easily replaced without contacting said solid block; and fluid passing means formed between said plastic container and said cap portion for passing said flushing fluid from said central passage to said annular space for providing contact between said flushing fluid and said solid block forming a chemically treated flushing fluid outlet means formed in said base portion in fluid communication with said annular space and said flow passage and wherein said cap portion cooperates with said central passage for routing said flushing fluid through said dispenser and being threadedly engaged to said base portion for providing a leakproof seal.

20. The deodorant dispenser of claim 19 further including a sealing means located between said base portion and said cap portion for providing a leakproof seal.

21. The deodorant dispenser of claim 19 further including an anti-siphon valve mounted in the top of said cap portion in line with said central passage for eliminating pressure differentials and siphoning effects within said deodorant dispenser.

22. The deodorant dispenser of claim 21 wherein said anti-siphon valve is spring-loaded normally closed and is opened when the atmospheric pressure exceeds the internal pressure of said dispenser.

23. The deodorant dispenser of claim 19 wherein said deodorant dispenser further includes an annular passage located within said plastic container for collecting said flushing fluid after contacting said solid block of disinfectant deodorizer.

24. The deodorant dispenser of claim 19 wherein said base portion further includes a drain port for discharging said chemically treated flushing fluid.

25. A deodorant dispenser for chemically treating the flushing fluid of a marine toilet comprising, in combination:

means for mounting said deodorant dispenser to a flushing fluid line and including a fluid passage therethrough and a central passage communication with said fluid passage and extending laterally therefrom;

means for admitting said flushing fluid, said admitting means in mechanical communication with said fluid passage for providing an inlet connection;

means for discharging said flushing fluid, said discharging means in mechanical communication with said fluid passage for providing an outlet connection, said admitting and discharging means each being of constant diameter;

fluid diverting means in said flow passage for routing a portion of said flushing fluid in said fluid passage into said central passage within said deodorant dispenser;

a solid chemical block mounted around said central passage, containing means threadedly seated within said mounting means for encapsulating said solid chemical block mounted about said central passage, an annular space between said containing means and said block, said containing means having a plurality of vertical slots for directing said flushing fluid to said annular space between said containing means and said block, said containing means being enclosed within a housing means and being easily replaced without contacting said block; and fluid passing means formed between said containing means and said housing means for passing said flushing fluid from said central passage to said annular space for providing contact between said flushing fluid and said block forming a chemically treated flushing fluid outlet means formed in said mounting means in fluid communication between said annular space and said flow passage wherein said housing means cooperates with said central passage for routing said flushing fluid through said dispenser, said housing means being comprised of a top section and a body section wherein said top section is threadedly connected to said body section and said body section is threadedly engaged to said mounting means for providing a leakproof seal.

26. A deodorant dispenser for chemically treating the flushing fluid of a marine toilet comprising, in combination:

a base portion having a flow passage therethrough and including means for mounting said deodorant dispenser to a flushing fluid line, said base portion further including a central passage communicating with said flow passage and extending laterally therefrom;

a flushing line inlet connection in mechanical communication with said flow passage in said base portion for admitting said flushing fluid;

a flushing line outlet connection in mechanical communication with said flow passage in said base portion for discharging said flushing fluid, said inlet and outlet connections each being of constant diameter;

a diverting wall within said flow passage for routing a portion of said flushing fluid in said flow passage into said central passage of said deodorant dispenser;

a solid block of disinfectant deodorizer mounted around said central passage, a plastic canister threaded within said base portion and encapsulating said solid block of disinfectant deodorizer mounted about said central passage, an annular space between said container and said block, said central passage penetrating the center of said plastic container for receiving and directing said flushing fluid, said plastic container having a plurality of vertical slots for directing said flushing fluid to said annular space between said plastic container and said solid block, said plastic container being housed within a cap portion and being easily replaced without contacting said solid block; and fluid passing means formed between said plastic canister and said cap portion for passing said flushing fluid from said central passage to said annular space for providing contact between said flushing fluid and said solid block forming a chemically treated flushing fluid outlet means formed in said base portion in fluid communication with said annular space and said flow passage and wherein said cap portion cooperates with said central passage for routing said flushing fluid through said dispenser, said cap portion being comprised of a top section and a body section wherein said top section is threadedly connected to said body section and said body section is threadedly engaged to said base portion for providing a leakproof seal.

27. The deodorant dispenser of claim 26 wherein said plurality of vertical slots expel said chemically treated flushing fluid to an annular passage located between said base portion of said dispenser and said threaded portion of said canister.

28. The deodorant dispenser of claim 27 wherein said annular passage directs said chemically treated flushing fluid to a drain port located in said base portion for discharging said flushing fluid to said flushing line outlet connection.

29. The deodorant dispenser of claim 26 wherein said deodorant dispenser further includes a sealing means located between said base portion and said cap portion for providing a leakproof seal.

* * * * *